United States Patent [19]

Clauss

[11] Patent Number: 4,546,911

[45] Date of Patent: Oct. 15, 1985

[54] HEAT-SEALABLE COATED PAPER CONTAINER AND METHOD OF MANUFACTURE

[75] Inventor: Gerhard Clauss, Donzdorf, Fed. Rep. of Germany

[73] Assignee: Michael Hoerauf Maschinenfabrik GmbH & Co KG, Fed. Rep. of Germany

[21] Appl. No.: 473,714

[22] Filed: Mar. 9, 1983

[30] Foreign Application Priority Data

Mar. 10, 1982 [DE] Fed. Rep. of Germany ..... 3208682
Jul. 30, 1982 [DE] Fed. Rep. of Germany ..... 3228437

[51] Int. Cl.[4] ..... B65D 3/22; B65D 13/04

[52] U.S. Cl. ..... 229/5.6; 220/67; 493/297; 493/379

[58] Field of Search ..... 229/5.5, 5.8, 21, 4.5, 229/1.5 B, 5.6, DIG. 5; 220/66, 67; 493/96, 110, 326, 327, 109, 108, 158, 386, 379, 344, 349, 308, 297, 303

[56] References Cited

U.S. PATENT DOCUMENTS

| | | | |
|---|---|---|---|
| 1,959,193 | 5/1934 | Boeye | 229/DIG. 5 |
| 2,416,813 | 3/1947 | Barbieri | 229/21 |
| 2,440,339 | 4/1948 | Langer | 229/48 T |
| 2,540,565 | 2/1951 | Barbieri | 229/21 |
| 3,072,517 | 1/1963 | Gaylord | 229/5.5 |
| 3,242,829 | 3/1966 | White | 493/308 |
| 3,949,927 | 4/1976 | Smith et al. | 229/5.5 |

*Primary Examiner*—Allan N. Shoap
*Assistant Examiner*—Bryon Gehman
*Attorney, Agent, or Firm*—Craig and Burns

[57] ABSTRACT

A wound double-walled container and method of manufacturing the same from coated paper includes two blanks which are placed one above the other and which form the container walls. The blanks are arranged mutually offset in such a manner that narrow foldable strips project laterally and foladble rim portions extend at the top and bottom, which are folded over for sealing the inwardly and outwardly and endwise disposed cut edges. The folding-over takes place either after the winding of the blanks or while the individual blanks are still flat, which thereafter are wound separately one after the other about a winding mandrel and are sealed.

16 Claims, 22 Drawing Figures

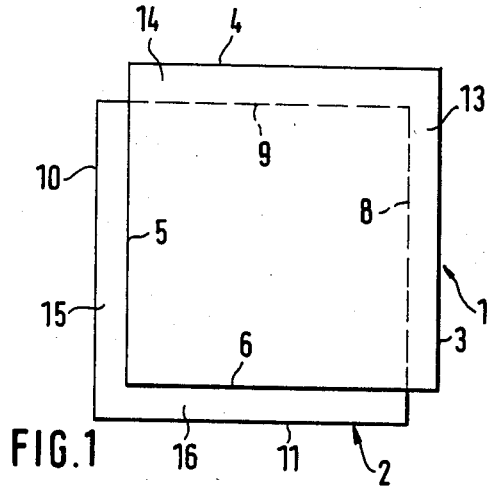
FIG.1
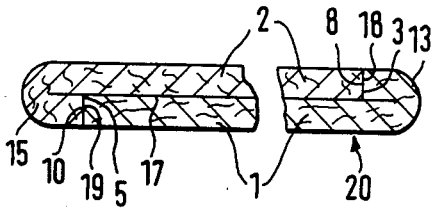
FIG.2
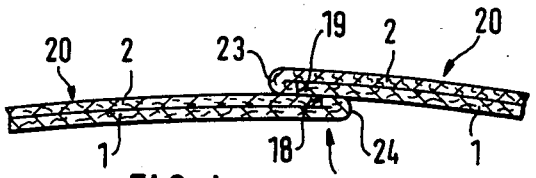
FIG.4
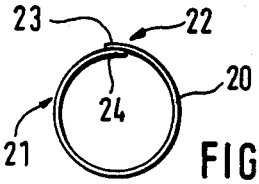
FIG.3
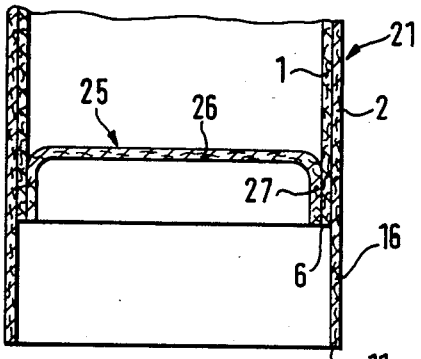
FIG.5
FIG.6
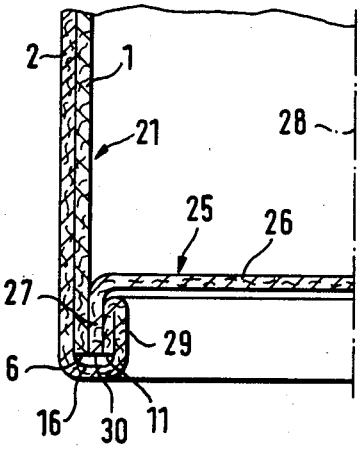
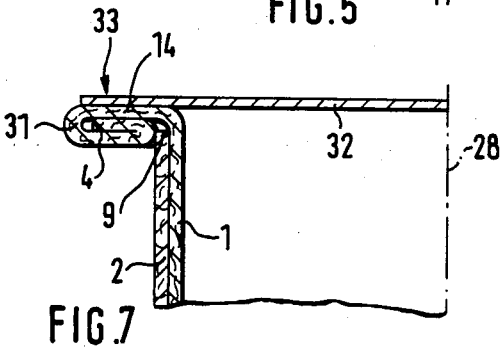
FIG.7

HEAT-SEALABLE COATED PAPER CONTAINER AND METHOD OF MANUFACTURE

BACKGROUND OF THE INVENTION

The present invention relates to a paper container of heat-sealable coated surface-protected cardboard which includes a wound container wall and of a container bottom connected therewith. The ends of the container wall blank are overlapped and the end disposed on the container inside is folded over toward the outside for covering off the inner cut edge. The present invention also relates to a method for the manufacture of such a container.

Paper containers of the aforementioned type are generally known in the prior art (see for example German Offenlegungsschrift 30 23 835), such containers customarily being filled with liquid, for example, with fruit juices. The surface coating in this prior art device extends only over the outer wall surfaces so that, if no special measures are taken, the exposed inner cut edge is unprotected as a result of the overlap of the ends of the outer container wall. This cutting edge is permeable by the liquid container content so that the liquid contained therein can penetrate into the paper and soften the same. For purposes of avoiding this disadvantage, provision is made in prior art paper containers to scrape off or abrade the end strip which is on the inside after the winding operation, essentially to half the material strength over a predetermined width. The abraded area is subsequently folded in such a manner that the end surface of the abraded area and the end surface of a non-abraded area of the blank contact one another. The container wall structured in this manner results in a container having a constant wall thickness. Subsequent to the folding over the abraded end strip, the end surface of the blank is then provided with a waterproof coating. The otherwise exposed inner cut edge is thus covered off.

The exact abrading of the end area of the wall blank in the above-noted prior art device can be realized only with great technical difficulties, especially as the overall wall thickness of the container is already very thin. Additionally, the container, which results after the winding operation and the insertion of the bottom, is not sufficiently rigid to resist denting. Therebeyond, the problem exists that when the grinding dust is not adequately removed, resulting in residues thereof which remain in the container, there is concern for hygienic reasons.

SUMMARY AND OBJECTS OF THE INVENTION

The present invention is concerned with the improvement of containers generally of the aforementioned type in such a manner that the manufacture is simplified, that the resulting container exhibits a greater rigidity and that no grinding dust occurs during the blank preparation.

The present invention provides for the container wall being constructed double-walled and the blank of the inner wall including a rim portion protruding with respect to the blank of the outer wall, which rim portion is folded over in an overlapping area. The offset superposition of the blanks is considerably more simple to manufacture than the abrading of an end strip area of a wall blank. The wall thicknesses may be so selected that the resulting overall wall thickness is not greater than the wall thickness of a single-walled paper container. As a result of the laminate type of construction resulting from the double-walled structure, especially with a glue layer disposed therebetween, the container becomes altogether more rigid. Additionally, the insulating properties are improved.

Ideally, the rim portion of the blank of the inner wall is so dimensioned that its cut edge, after the folding operation, forms a butting edge with the respective cut edge of the outer wall. As a result of this measure, the cut edges seal themselves automatically and additionally, the abutting edges are covered off by the outer part of the overlapping piece of the container wall.

It is of advantage if the blank of the outer wall includes a portion which projects with respect to the blank of the inner wall, which portion is foldable inwardly within an overlapping area for covering the outer cut edge. Consequently, the same measures are taken in this case for the outer cut edge as for the inner cut edge so that the container wall is also protected from the outside against the penetration of moisture. It is thereby also appropriate in this case to so dimension the rim portion that its cut edge, after the folding operation, forms an edge which abuts with the associated cut edge of the inner wall.

According to another feature of the present invention, provision is made that a container bottom is inserted into the would container wall, the sealing rim of the bottom being bent downwardly. The blank of the outer wall includes a lower rim portion projecting with respect to the blank of the inner wall. The rim portion is so flanged over about the sealing rim of the container bottom with the lower cut edges of the outer wall, of the inner wall and of the container bottom thereby being covered off. This measure, in addition to sealing off the inner and outer cut edges of the wall blanks, makes possible an additional sealing off of the cut edges within the area of the container bottom. It is thereby appropriate from the point of view of manufacture for the sealing rim terminate flush with the inner wall.

According to still a further feature of the present invention, provision is made for the blank of the inner wall to include an upper edge portion projecting with respect to the blank of the outer wall, which is flanged over outwardly into a rolled-together lip in such a manner that the upper cut edges of the outer wall and of the inner wall are covered off. The rolled-together lip may be pressed flat thereby may support the sealing edge of a container lid or cover. This container lid or cover is ideally applied as impervious foil after the container has been filled. Such filling, as a rule, is hot when the container is closed off and subsequent to the filling, the container is immersed in a very cold liquid bath for chilling. The measures described heretofore assure that the paper container is completely sealed off both from the inside as well as from the outside, in every direction, so that any after-treatment in a liquid-treatment medium is harmless for the paper container.

As a modification of the advantageous construction of the present invention just described, the upper cut edges of the outer wall and of the inner wall may be arranged so that they are not offset and disposed within an annular groove of a cover ring which supports the sealing edge of the container lid. This cover ring is placed over the cut edges of the upper container part so that the flanging over of the inner container wall about the outer wall can be dispensed with within this area.

Accordingly manufacturing expenditures are thereby reduced.

The blanks for the container wall are advantageously glued or sealed together over their entire area. It is also possible that the two walls have different wall thicknesses. The latter is the case in particular if different coatings are used for the inner and the outer wall. For example, the outer wall may be provided with an aluminum layer on the inside thereof and with a polyethylene layer on the outside thereof whereas the inner wall may be provided only with a polyethylene layer on the inside thereof. A double-wall structure constructed laminate-like results therefrom which—now viewed as a unit—includes in the center an aluminum layer and one polyethylene layer on each of its outer areas.

For purposes of increasing the rigidity of the paper container, provision may be made that the fiber directions of the blanks of the walls are offset to one another by 90°. A different elasticity modulus results therefrom for each individual wall—similar to the plywood effect—whereby the individual bending tendencies are directed mutually opposite.

Various advantageous methods are suitable for the manufacture of the container of the present invention. In a first method step, provision is made that the completed blanks for the inner wall and the outer wall are placed flat one on top of the other but slightly offset to one another so that rim portions result from the offset arrangement. In further operating steps, the blanks can be glued together or sealed together. Subsequently, the inwardly disposed portion of the container wall can be folded over in the overlapping area and when the projecting portion is present in the outer wall it area can also be folded over. Finally the double-wall blank of the container wall can be formed in a winding operation. This method can subsequently be completed by the container bottom being inserted into the wound container wall and the lower rim portion, when present, being flanged over about the sealing rim of the container bottom. The upper rim portion, when present, may then be flanged over in a corresponding manner into a rolled-together lip. In the alternative, the upper cover ring may be placed over the upper edge of the wound container wall.

A second method of the present invention consists of folding over the lateral off set portions prior to the winding operation. The composite blanks forming the container wall are therefore made individually according to this method and are pre-folded over along the lateral edges which subsequently overlap in the completed container wall, before the blanks are placed about the winding mandrel. This can be realized more readily from a technical point of view than a subsequent folding on the winding mandrel. Thereafter, the blanks are wound individually on the same winding mandrel and are glued together or sealed together, whereby the cut edges are completely sealed off by the method of the present invention.

A still further method for the manufacture of the paper container in accordance with the present invention includes two paper webs of identical width placed one upon the other but wherein each web is provided with projecting rim strips. The webs are fed to a processing station and subsequently the blanks for the walls, which are already disposed one on top of the other, are separated and are glued together or sealed together and thereafter the double-walled container wall is wound. It is no longer necessary with this method to first make the individual blanks and to place the same one above the other. Instead, the individual blank walls can be peeled off, each from its own long foil web, whereby they are unwound laterally offset to one another. However, utilizing this arrangement means that it is only possible thereby to cover off the inner and outer cut edges of the container wall. The sealing off of the upper cut edge of the container would have to take place in this case with the described cover ring. A ring would also have to be mounted in a corresponding manner over the bottom cut edge, etc.

A still further method for the manufacture of the paper container of the present invention sets forth that the blank for the inner wall is first wound, thereafter the blank for the outer wall is wound separately about the inner wall, leaving free foldable portions, and subsequently the foldable portions are folded over. This method makes it possible to shift the offset arrangement of the individual blanks to that operating step in which the blank is anyhow moved for winding the same on a mandrel.

These and other objects, features and advantages of the present invention will become more apparent from the following description when taken in connection with the accompanying drawing which shows, for purposes of illustration only, several embodiments in accordance with the present invention, and wherein:

FIG. 1 is a schematic view on two blanks for forming the container wall of a container constructed in accordance with the present invention, which are mutually offset one on top of the other;

FIG. 2 is a partial cross-sectional view, on an enlarged scale, through the two blanks with folded-over portions in accordance with the present invention;

FIG. 3 is a schematic view illustrating an example of wound container walls with overlapping ends in accordance with the present invention;

FIG. 4 is a partial cross-sectional view, on an enlarged scale, illustrating the area of the overlapping ends of the wound container wall in accordance with the present invention;

FIG. 5 is a partial longitudinal cross-sectional view through a container in accordance with the present invention with a bottom inserted into the wound container wall prior to flanging over the outer wall;

FIG. 6 is a partial cross-sectional view, similar to FIG. 5 and illustrating the bottom inserted into the wound container wall and the flanging over of the outer wall;

FIG. 7 is a partial cross-sectional view of the upper area of the container in accordance with the present invention, illustrating the flanging over of the inner wall into a rolled-together lip pressed flat with a foil cover in accordance with the present invention;

Figure 8:
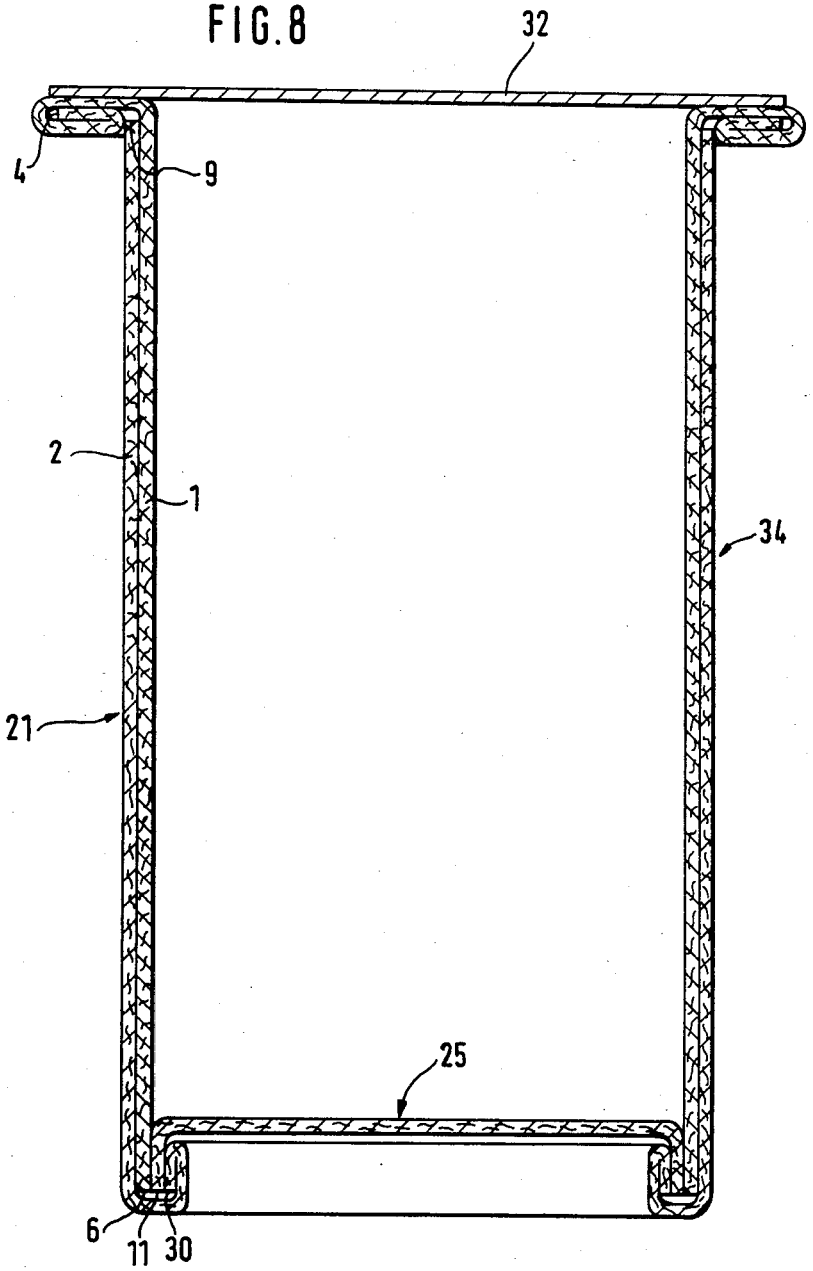
FIG. 8 is a longitudinal cross-sectional view through a completed paper container in accordance with the present invention which is sealed on all sides.

Referring now to the drawing wherein like reference numerals are used throughout the various views to designate like parts, and more particularly to FIG. 1, this figure illustrates two superposed flat blanks lying one on top of the other with the subsequent inner wall generally designated by reference numeral 1 and the subsequent outer wall, i.e. jacket, generally designated by reference numeral 2. Both blanks are preferably of a surface-protected cardboard or the like which is coated and adapted for heat-sealing on at least the surface opposite the other blank. The blank for the wall 1 is delimited by the lateral edges 3, 4, 5 and 6. The blank for the wall 2 is delimited by the lateral edges 8, 9, 10 and 11. The blanks are placed one on top of the other mutually offset in such a manner that a projecting foldable portion 13, which after the winding operation of the container wall comes to lie on the inside, and a projecting foldable portion 15, which after the winding operation of the container wall comes to lie on the outside, project along the edges of the composite blank formed by the blanks 1 and 2. The portions 13 and 15 are thus disposed within the areas of the overlapping ends of the subsequent wound container wall. One can also recognize in this figure a rim portion 16 depending from blank 2 which is responsible for the sealing of the subsequently added container bottom. Analogously, a rim portion 14 extends from blank 1 which subsequently assumes the covering of the upper container edge in a manner to be described more fully hereinafter.

The blanks for the walls 1 and 2 are appropriately glued together or sealed together in the condition illustrated in FIG. 1.

In FIG. 2, the blanks for the walls 1 and 2 are shown in cross section on an enlarged scale. The folded-over portion 13 and 14 of each can be recognized in particular in this figure. The edges 3 and 8 described hereinabove form a butting edge 18 after the folding over operation and the edges 5 and 10 described hereinabove form a butting edge 19 after the folding over operation. The blanks for the walls 1 and 2 are glued together or sealed together along the surface designated by reference numeral 17. It can be seen from FIG. 2 that no thickening of the double wall occurs within the area of the folded-over portions 13 and 15.

After the folding over of the portions 13 and 15, the composite double-walled blank 20 is then wound into a container wall corresponding to FIG. 3, whereby the end areas 23 and 24 of the composite container wall 21 form an overlapping area 22.

This overlapping area 22 is illustrated in cross section on an enlarged scale in FIG. 4. One can recognize in this figure the composite double wall 20 which includes an inner wall 1 and of an outer wall 2. The wall 1 which lies on the inside in the finished container, is folded over outwardly in this manner described hereinabove and forms with the outer wall 2 the butting edge 18. The outer wall 2 is folded over toward the inside within the overlapping area 22 in a corresponding manner and forms with the inner wall 1 the butting edge 19. The butting edges 18 and 19 are so arranged, at a distance relative to one another in the overlapping area 22, that they are covered by the respective double wall 20, i.e., the butting edge 19 is covered off by the end piece 24 and the butting edge 18 is covered off by the end piece 23 of the overlapping area 22. In this manner the container wall is completely sealed along its longitudinal edges both on the outside and on the inside. The overlapping area 22 is then heat-sealed.

FIG. 5 illustrates in longitudinal cross section the wound container wall 21 with its inner wall 1 and its outer wall 2, which projects downwardly with portion 16—which is also wound—with respect to the wall 1. A container bottom 25 which includes a radial web 26 as well as a sealing rim 27, is inserted into the container wall 21 in such a manner that the downwardly bent sealing rim 27 terminates flush at the bottom with the inner wall 1.

It can be seen from FIG. 6 how the rim portion 16 of the outer wall 2 of the container wall 21 is flanged over a means of a flanged rim 29 about the sealing rim 27 of the container bottom 25. Accordingly, the exposed cut edge 6 of the inner wall 1, the exposed cut edge 11 of the outer wall 2 as well as the exposed cut edge 30 of the sealing rim 27 of the container bottom 25 are covered off by the flanged-over portion 29. This flanged-over portion 29 is pressed flat, and the entire folded-over area at the lower end of the container is welded together. The center axis of the paper container is indicated by reference numeral 28.

The upper area of the paper container is illustrated in cross section in FIG. 7. One can recognize in this figure that the inner wall 1, which forms the upper rim portion 14, is flanged over toward the outside into a rolled-over lip 31 and is pressed flat in such a manner that the cut edge 9 of the outer wall 2 as well as the cut edge 4 of the inner wall 1 are covered off. A foil cover or lid 31 with a sealing rim 33 rests sealingly on this rolled-over lip 31.

The paper container generally designated by reference numeral 34 and made in accordance with the method described hereinabove is illustrated in FIG. 8, the wall thicknesses thereof are illustrated greatly exaggerated for illustrative purposes. One can recognize in this figure the inner wall 1 as well as the outer wall 2 of the composite container wall generally designated by reference numeral 21, and additionally, the bottom generally designated by reference numeral 25 and in this area the sealed off cutting edges 6, 11 and 30 as well as the cut edges 4 and 9 being sealed off within the area of the cover foil 32. Such a paper container 34 is thus completely sealed inside and outside and in all directions and, on the one hand, can be provided with a liquid filling and, on the other, can be further processed in a liquid treatment bath after the filling and closing. Clearly, the paper of the walls and bottom will be unaffected by any liquid contacting therewith because of the coating and because of the fact that all of the cut edges are covered off and sealed.

Figure 9:
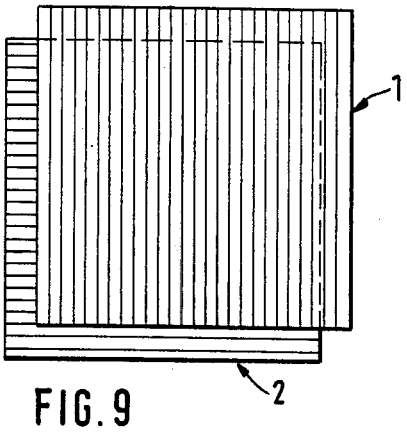
FIG. 9 is a schematic view of two blanks disposed one on top of the other in accordance with the present invention with mutually perpendicular fiber orientation.

FIG. 9 illustrates the blanks for the walls 1 and 2 in which the respective fiber directions or orientations are mutually offset by 90°. The overall rigidity of the paper container to be wound can be increased thereby.

Figure 10:
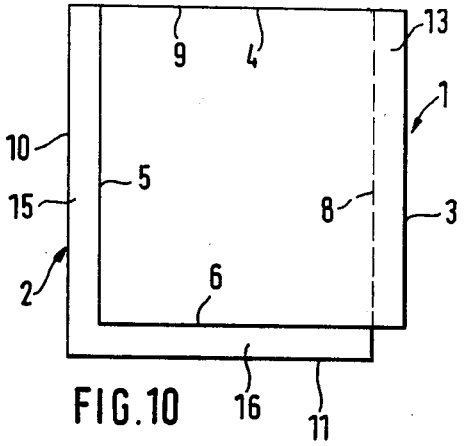
FIG. 10 is a schematic view of two blanks for a paper container without a rolled-together lip disposed one on top of the other in accordance with the present invention and which are disposed flush one on top of the other in the upper area.

FIG. 10 corresponds to FIG. 1 with the difference being that the respective upper edges 4 and 9 are not offset to one another so that the rim portion 14 of FIG. 1 is eliminated. As to the remaining details, FIG. 10 corresponds to FIG. 1.

Figure 11:
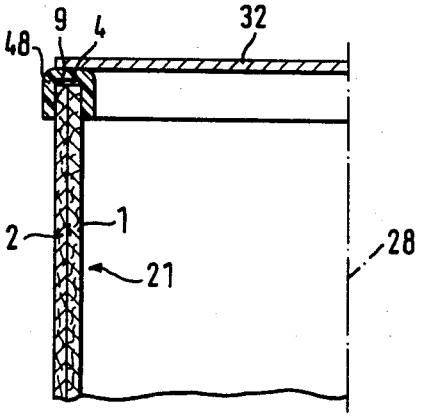
FIG. 11 is a partial cross-sectional view through the upper area of a container made in accordance with the present invention, and utilizing the blanks of FIG. 10, with a cover ring for covering off the paper container.

As a result thereof, it is no longer possible, as illustrated in FIG. 11, to flange over the inner wall 1 into a rolled-over lip sealing off the cut edge 9. For purposes of covering the open cut edges 4 and 9 of the inner wall as well as of the outer wall of the container wall 20, a cover ring 48 is provided which is placed includes an annular groove for receiving the container wall 21. After the filling of the paper container, this cover ring 48 has attached thereto and carries the upper cover foil 32. The cover ring 48 itself is made of synthetic plastic material so that its open cut edges are harmless.

Figure 12:
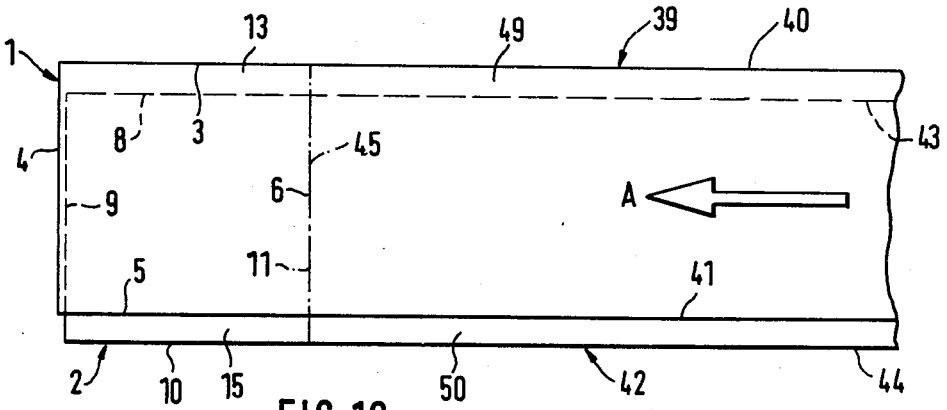
FIG. 12 is a schematic view illustrating the feed of foil webs in lieu of individual blanks in accordance with the present invention.

Differing from the manufacturing method described so far, is the method according to FIG. 12, wherein two paper webs generally designated by reference numerals 39 and 42 are fed in the direction of arrow A to a working station. The paper web 39 has the lateral boundaries 40 and 41 while the paper web 42 has the lateral boundaries 43 and 44. The paper webs 39 and 42 are thus laterally offset with respect to one another in such a manner that strips 49 and 50 project in each case.

The composite sealed-together blanks formed by walls 1 and 2 are separated off in the processing station, not described in detail herein, from the paper webs 39 and 42, along a separating edge 45 by conventional means. Thus, two mutually offset and already sealed blanks will result of which the blank for the inner wall generally designated by reference numeral 1 includes the lateral edges 3, 4, 5 and 6 as well as the blank for the outer wall generally designated by reference numeral 2 having lateral edges 8, 9, 10 and 11. The foldable portions 13 and 15 resulting thereby serve in the manner described hereinabove for sealing the inner and outer cut edges of the container wall 21.

In the method according to FIG. 12, the upper cut edges 4 and 9 as well as the lower cut edges 6 and 11 are not to be sealed off by folding over. For this reason, the upper area of the paper container has to be constructed corresponding to FIG. 11 and also the lower area has to be covered off by a corresponding insert or cover ring (not shown).

Figure 13:
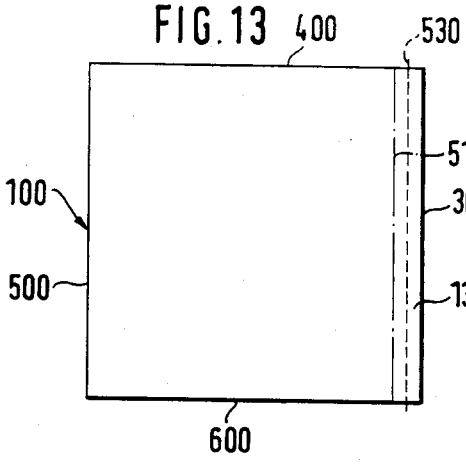
FIG. 13 is a view of the blank for the inner container wall in the not-yet-folded condition.

FIG. 13 illustrates a flat blank generally designated by reference numeral 100 for subsequently forming an inner wall. Blank 100 is of surface-protected cardboard coated and adapted to be heat-sealable. The blank 100 is delimited by the lateral edges 300, 400, 500 and 600. It includes a lateral foldable portion 130 which is delimited by the imaginary line 510 illustrated in dash and dotted lines. A dash line is designated by reference numeral 530, about which the blank 100 is subsequently folded in a manner to be described hereinafter so that the rim portion 130 becomes double-walled after this folding operation.

Figure 14:
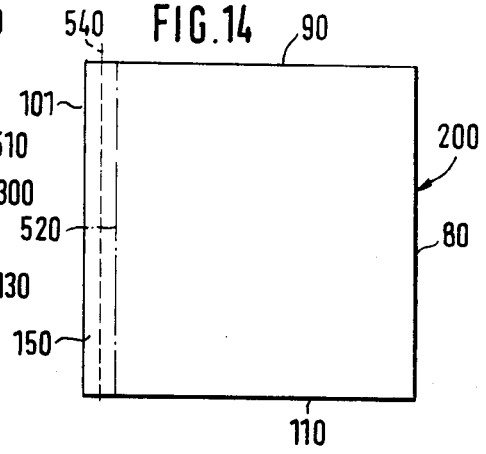
FIG. 14 is a view of the blank for the outer container wall in the not-yet-folded condition.

FIG. 14 illustrates the flat blank generally designated by reference numeral 200 for subsequently forming an outer wall. Blank 200 is also of a surface-protected cardboard coated and adapted to be heat-sealable. The blank 200 is delimited by the lateral edges 80, 90, 101 and 110. The blank 200 also includes a lateral portion 150 which is delimited by an imaginary dash and dotted line 520. The blank 200 is also folded over subsequently about the dash axis 540 in a manner to be described hereinafter so that the rim portion 150 becomes double-walled.

Figure 15:
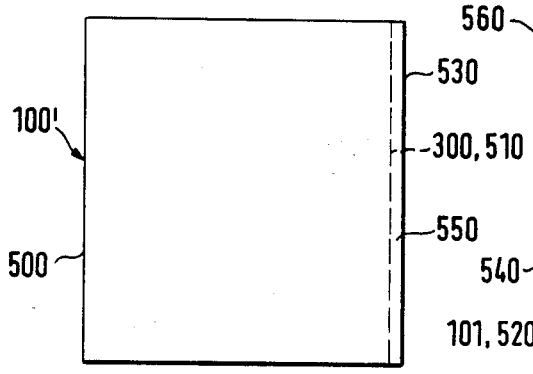
FIG. 15 is a view on th folded blank for the inner container wall.

In FIG. 15, the flat blank 100 which subsequently forms the inner wall is illustrated in a folded condition 100' in which it is laterally folded over above edge 530. It can be seen from this figure that after the folding operation, the lateral edge 300 coincides with the imaginary line 510 indicated in dash-and-dotted lines in FIG. 13. A narrow strip 550 results thereby which is double-walled. This condition is illustrated in an end view in FIG. 17.

Figure 16:
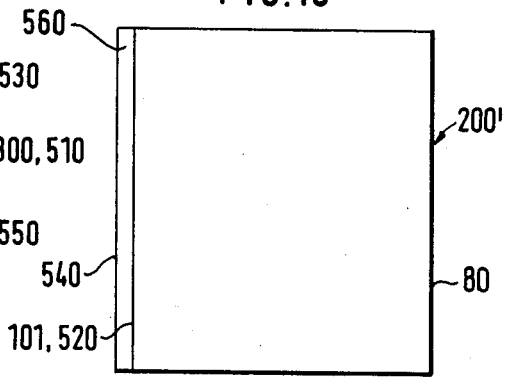
FIG. 16 is a view on the folded blank for the outer container wall.
Figure 18:
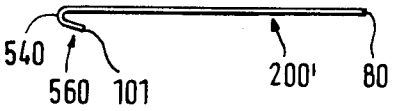
FIG. 18 is an end view of the blank according to FIG. 16.

FIG. 16 illustrates the flat blank 200 which subsequently forms for the outer wall in a folded over condition 200; the blank being folded about the edge 540 illustrated in dash line in FIG. 14 so that its lateral edge 101 coincides with the imaginary line 520 illustrated in dash and dotted lines in FIG. 14. Thus, the blank 200' is double-walled within the area 560. FIG. 18 illustrates this condition in an end view.

Figure 17:
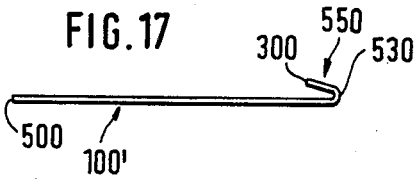
FIG. 17 is an end view of the blank according to FIG. 15.

It can be seen from FIGS. 15 and 17 as well as from FIGS. 16 and 18 that the folding-over takes place in different directions, i.e., in the illustration according to FIG. 17, the folding-over took place in the upper direction and in the illustration according to FIG. 18 in the downward direction.

Figure 19:
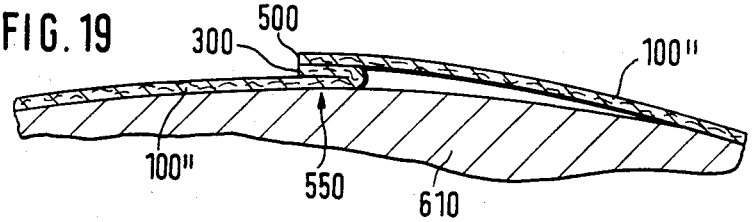
FIG. 19 is a partial cross-sectional view, on an enlarged scale, through the area of the overlapping ends of a wound inner container wall in accordance with the present invention.

The folded blank 100' provided with the double-walled lateral rim 550, is subsequently wound about a conventional winding mandrel 610 (FIG. 22) into the inner wall 100''. The overlapping area of this wound configuration is illustrated on an enlarged scale in FIG. 19. The overlapping thereby takes place appropriately in such a manner that the lateral edges 300 and 500 approximately coincide. In this condition, the overlapping area of the wound inner wall 100'' is already sealed and pressed together.

The folded blank 200' prefolded along the lateral edge, is now wound in a separate operating step about the inner wall 100'' into an outer wall 200''. It is thereby advantageous—as will be explained hereinafter—to glue the prefolded blank 200' to the formed inner wall 100''.

Figure 20:
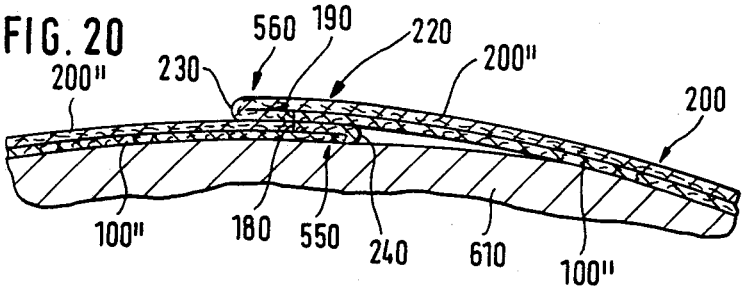
FIG. 20 is a partial cross-sectional view, on an enlarged scale, through the area of the overlapping ends of the wound inner and outer container walls in accordance with the present invention.

FIG. 20 illustrates in enlarged cross section, the overlapping area 220 of the wound inner wall 100'' and of the wound outer wall 200''. It can be seen from this Figure that—apart from the narrow overlapping place generally designated by reference number 220—the container wall has a composite double-wall construction 210. The outer wall 200'' is thereby wound about the inner wall 100''—analogously to the type of wound construction described in connection with FIG. 19—in such a manner that also in this case the lateral edges 80 and 101 come to lie approximately one above the other. As a result thereof, after a completed winding operation of the inner wall 100" and of the outer wall 200", butting edges 180 and 190 are formed (FIG. 20) which are arranged in the overlapping area 220 in such a manner that they are shielded both from the container inside and also from the container outside. The butting edges 180 and 190 are, as can be seen from FIG. 20, covered off by the end pieces 230, respectively, 240 in the overlapping area 220. In this manner, the composite double wall 210 is completely sealed off on the outside and on the inside along its longitudinal edges. The overlapping area 220 is heat-sealed and pressed together.

Figure 21:
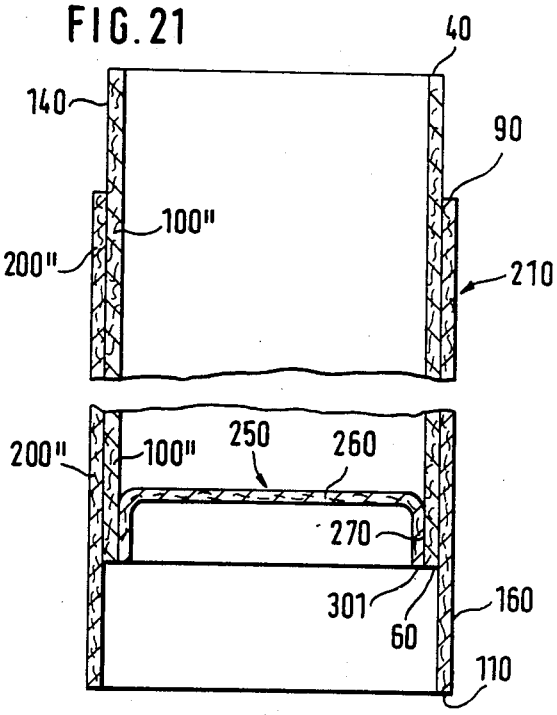
FIG. 21 is a longitudinal cross-sectional view through the upper and lower area of wound container walls in accordance with the present invention prior to flanging over of the ends but with the bottom inserted.

FIG. 21 illustrates in longitudinal cross section the wound container wall generally designated by reference numeral 210 with its inner wall 100" and its outer wall 200". The winding was thereby realized in such a manner that the inner wall 100" projects upwardly with an upper rim portion 140 and the outer wall 200" projects downwardly with a lower rim portion 160. In FIG. 21, the next method step has been already realized, in the course of which a container bottom generally designated by reference numeral 250, which includes a radial portion 260 as well as a sealing rim 270, has already been inserted into the container bounded by wall 210 in such a manner that the downwardly bent sealing rim 270 terminates flush at the bottom with the inner wall 100". In this condition, the upper cut edges 40 and 90 are still present in the upper area and the exposed cut edges 60, 110 and 301 are still present in the lower area. The container bottom does not necessarily have to be made from paper. It could also be a metal or synthetic resinous material bottom. The container is then finished in the same manner as described above in reference to FIGS. 5–8.

Figure 22:
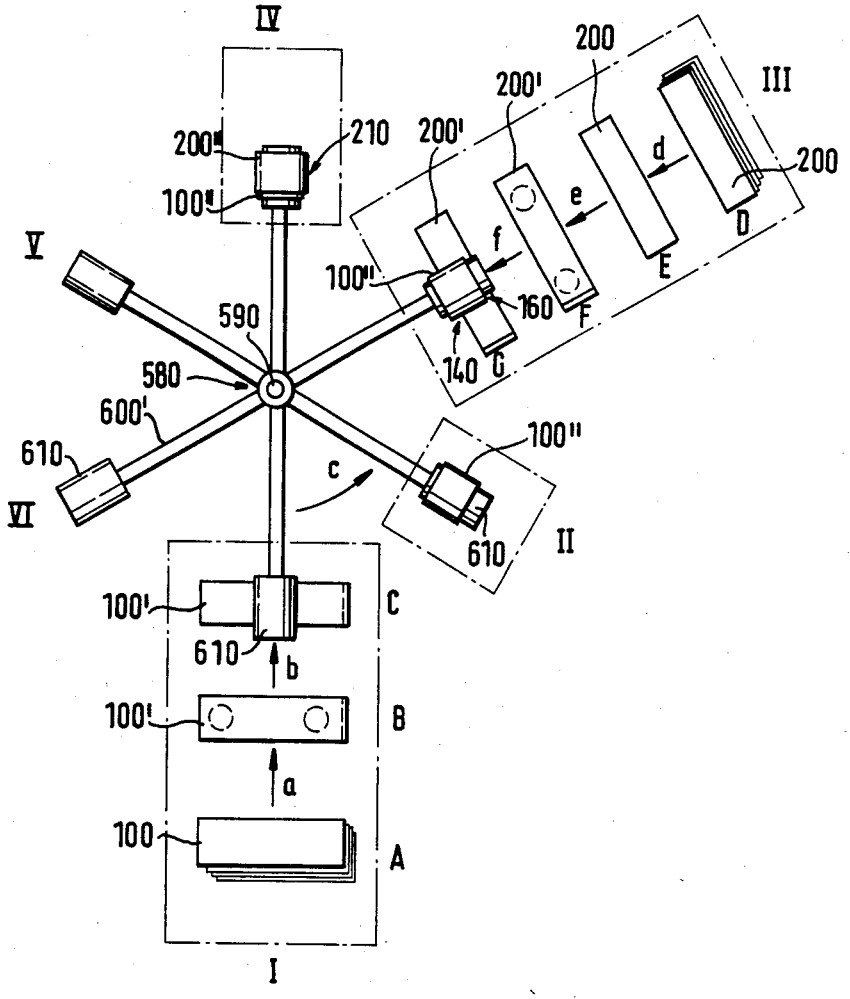
FIG. 22 is a schematic view of a star-shaped winding machine for carrying out the method of the present invention.

FIG. 22 illustrates a star-shaped winding machine generally designated by reference numeral 580 which is known as such in its general aspects, with operating stations I, II, III and IV for carrying out the method according to the present invention. The star-shaped winding machine 580 is adapted to be driven about a stationary shaft 590 in the direction of arrow c and altogether includes at least six arms 600, arranged star-shaped, which carry each a winding mandrel 610 which is indicated cylindrical in the instant example.

The working station I which is schematically illustrated by a dash and dot rectangle, serves the preparation and winding of the inner wall 100". From a stack present at the preparing area A of the working station I, one blank 100 is initially conveyed individually in the direction of arrow a to the area B where the already-described folding of the blank 100 into the folded blank 100' is undertaken by conventional means. The folded blank 100' is acted upon with hot air or the like at the location B. It is subsequently conveyed in the direction of arrow b to the area C where it is wound about the winding mandrel 610 present thereat into the form illustrated in FIG. 19 and is sealed. Subsequently, the star-shaped winding machine 580 is cylically operated so that the winding mandrel 610 carrying the inner wall 100" reaches operation station II. At this instant, the next prefolded blank 100' can be fed in the manner described hereinabove in to the working station I and to the next winding mandrel 610.

The working station II accomplishes the completion of the inner wall 100" by sealing and subsequent pressing in the overlapping area. The winding mandrel 610 with the now completed inner wall 100" is subsequently rotated to the working station III.

A stack with blanks 200 is present at the location D of working station III. One blank 200 is conveyed individually in the direction of arrow d to area E and is provided thereat with a glue coating. In the alternative, in lieu of the gluing, an already previously applied coating material may be reactivated. After the further conveyance in the direction of arrow e to the location F, a heating with hot air or the like and the lateral folding into the blank 200' according to FIGS. 16 and 18 now takes place. The folded blank 200' is now conveyed in the direction of arrow f to the location G of the working station where it is wound about the already finished inner wall 100" and is sealed thereto. The composite double wall 210 then cycles together with the winding mandrel 610 to the working station IV where the final sealing and additional pressing operations take place. The composite container wall then possesses the form illustrated in FIG. 20 and/or 21.

Further operating stations V and VI, not described in detail herein, may be provided for the winding machine 580, for example, for the insertion of the container bottom and the flanging-over operation.

While I have shown and described several embodiments in accordance with the present invention, it is understood that the same is not limited thereto but is susceptible of numerous changes and modifications as known to those skilled in the art, and I therefore do not wish to be limited to the details shown and described herein, but intend to cover all such changes and modifications as are encompassed by the scope of the appended claims.

I claim:

1. A paper container of heat-sealable coated surface protected material comprising a wound container wall means and a container bottom means connected therewith, said container wall means being formed of a plurality of blank means bonded to one another, one of said blank means forming an inner wall means of said container and including a foldable portion projecting beyond a respective edge of another blank means, said another blank means forming an outer wall means, said another blank means forming an outer wall means and including a foldable portion extending beyond a respective edge of said inner wall means, said foldable portion of the inner wall means being foldable outwardly to cover off the respective edge associated therewith, said foldable portion of the outer wall means being foldble inwardly to cover off the respective edge associated therewith of said inner wall means, said foldable portions of said inner wall means and said outer wall means forming an area of overlap when said container wall means is wound wherein said covered off respective edge of said inner wall means and said covered off respective edge of said outer wall means are disposed within said area of overlap and spaced a distance relative to one another, whereby said container wall means is sealed inside and outside.

2. A paper container according to claim 1, wherein said foldable portion of the blank means forming the inner wall means includes a cut edge and said respective edge of said outer wall means includes a cut edge, after the folding over of the foldable portion, the cut edge of the inner wall means forms a butting edge with the respective cut edge of the outer wall means.

3. A paper container according to claim 2, wherein each of said plurality of blank means have unequal wall thicknesses.

4. A paper container according to claim 2, wherein the foldable portion of the blank means forming the outer wall means includes a cut edge and said respective edge of said inner wall means includes a cut edge, after the folding over of said foldable portion, the cut edge of the outer wall means forms a butting edge with the respective cut edge of the inner wall means.

5. A paper container according to claim 4, wherein the container bottom means includes a sealing rim and is inserted into one end of the wound container wall means, said sealing rim is bent downwardly and the blank means forming the outer wall means includes a lower rim portion projecting with respect to the blank means forming the inner walls means, said lower rim portion being folded over said sealing rim of the container bottom means in such a manner that lower cut edges of the winner wall means, of the outer wall means and of the container bottom means are covered off.

6. A paper container according to claim 5, wherein the blank means forming the inner wall means includes an upper rim portion projecting with respect to the blank means forming the outer wall means, said upper rim portion being folded over toward the outside into a rolled-over lip in such a manner that upper cut edges of the inner wall means and of the outer wall means are covered off.

7. A paper container according to claim 6, wherein the blank means forming the inner wall means and the outer wall means have unequal wall thicknesses.

8. A paper container according to claim 7, wherein fiber directions of the blank means forming the inner wall means and outer wall means are mutually offset by about 90°.

9. A paper container according to claim 6, wherein fiber directions of the blank means are mutually offset by about 90°.

10. A paper container according to claim 1, wherein fiber directions of the blank means forming the inner wall means and outer wall means are mutually offset by about 90°.

11. A paper container according to claim 1, wherein said container bottom means includes a sealing rim and is inserted into the wound container wall means, said sealing rim including a portion bent downwardly and said blank means forming the outer wall means including a lower rim portion projecting with respect to the blank means forming the inner wall means, said lower rim portion being folded over the bent portion of said sealing rim of the container bottom means in such a manner that lower cut edges of the inner wall means, of the outer wall means and of the container bottom means are covered off.

12. A paper container according to claim 1, wherein the blank means forming the inner wall means includes an upper rim portion projecting with respect to the blank means forming the outer wall means, said upper rim portion being folded over toward the outside into a rolled-over lip in such a manner that upper cut edges of the inner wall means and of the outer wall means are covered off.

13. A method for manufacturing a paper container of double-walled construction from heat-sealable coated surface-protected cardboard which includes a wound container wall and a container bottom connected therewith, comprising the steps of placing finished blanks for an inner wall and an outer wall flat and one above the other in such a manner that a projecting rim portion of the blank of the inner wall and a projecting rim portion of the blank of the outer wall will result, folding over the projecting rim portions in such a manner that the respective edges of the blank beyond which the respective rim portions extend are covered, winding the double-walled blank with folded rim portions into a container wall in such a manner that the edges covered by the folded over rim portions are staggered with respect to one another within an area of overlap formed when the double-walled blank is wound, and securing a bottom to an open end of the wound container wall.

14. A method according to claim 13, in which the blanks for the inner wall and the outer wall are placed flat and one above the other in such a manner that also a projecting rim portion of the blank of the outer wall will result.

15. A method according to claim 14, in which the rim portions are first folded over and thereupon the double-walled blank is wound into the container wall.

16. A method according to claim 13, wherein the finished blanks are glued or sealed together prior to the winding operation.

* * * * *